United States Patent [19]

Perkins et al.

[11] Patent Number: 4,527,456

[45] Date of Patent: Jul. 9, 1985

[54] MUSICAL INSTRUMENT

[76] Inventors: William R. Perkins, 3872 Cody Rd., Sherman Oaks, Calif. 91403; James L. Cooper, 3512 Rosewood Ave., Los Angeles, Calif. 90066

[21] Appl. No.: 510,726

[22] Filed: Jul. 5, 1983

[51] Int. Cl.[3] ..... G10H 3/00

[52] U.S. Cl. ..... 84/1.04; 84/1.01; 84/1.03; 84/1.24

[58] Field of Search ..... 84/1.04, 1.24, 1.01, 84/1.03, DIG. 14

[56] References Cited

U.S. PATENT DOCUMENTS

| | | | |
|---|---|---|---|
| 3,938,419 | 2/1976 | De Rosa | 84/1.14 |
| 4,085,646 | 4/1978 | Naumann | 84/1.11 |
| 4,342,244 | 8/1982 | Perkins | 84/1.01 |
| 4,385,541 | 5/1983 | Müller et al. | 84/1.04 |

OTHER PUBLICATIONS

Technical Data Sheet for Hall Effect Digital Sensors, Article entitled: "Computer Music, without the Computer, or: What to do 'til Your Processor Arrives". Data Sheet for 567 Tone Decoder Phase Locked Loop, by Signetics Corp.

*Primary Examiner*—Forester W. Isen
*Attorney, Agent, or Firm*—Roberts and Quiogue

[57] ABSTRACT

A novel music instrument is disclosed, comprising (i) a wind music instrument of the type wherein the emitted acoustic tone is dependent upon the placement of means such as valves or a slide which determine column length and the wind pressure exerted by the musician, (ii) a music synthesizer, and (iii) an interface apparatus. The interface apparatus includes sensing means for sensing the position of the instrument valves or slides and generating a sensing signal, transducer means for sensing characteristics of the note emitted by the wind instrument and generating a transducer signal, and a controller adapted to the type of wind instrument for generating a synthesizer control signal in response to the sensing signal and the transducer signal. By playing the instrument in a normal manner, the musician is able to also control the synthesizer to generate notes related to the notes emitted by the wind instrument. Pressure sensitive transducers are provided to allow the musician to introduce a vibrato effect or to alter the pitch of the notes generated by the synthesizer.

Other features and improvements are disclosed.

43 Claims, 9 Drawing Figures

MUSICAL INSTRUMENT

BACKGROUND OF THE INVENTION

1. Field of the Invention

The present invention relates to musical apparatus, and, more particularly, relates to the combination of a wind instrument and an electronic music synthesizer.

2. Description of the Prior Art

Due in part to the relatively high cost of providing an orchestra or group of performing musicians, the music synthesizer has become an important music instrument. For example, it is known that music accompanying a television program is quite often generated by a musician playing a music synthesizer to obviate the expense of a complete orchestra. Many synthesizers are adapted for keyboard operation, requiring the musician be trained as a keyboard musician. This is a limiting feature since the expertise of many musicians is limited to other non-keyboard musical instruments. Such musicians would be unable to skillfully utilize a keyboard synthesizer without additional training.

It is, therefore, desirable to provide a means to allow the musician to control the synthesizer in a manner which utilizes the musician's existing expertise in playing a musical instrument, and which does not require extensive retraining in keyboard instruments. One of the inventors of the present invention has addressed this need with respect to musical instruments having substantially a one-to-one relationship between each key and an associated note. U.S. Pat. No. 4,342,244 discloses a music apparatus which allows a musician to control the output of a music synthesizer while playing his own music instrument, e.g. a saxaphone, in a normal manner. This music apparatus does not solve the problem associated with music instruments such as the trumpet wherein there is not a substantially one-to-one relationship between the setting of the instrument keys or valves and the associated note. With such instruments the range of the note produced can also be varied by the musician varying his lip configuration on the instrument mouthpiece. Thus, with a given valve selection, the musician may produce not only the primary note but may produce one or more overtones of the primary note by varying his lip configuration.

U.S. Pat. No. 3,938,419, issued to De Rosa, discloses an attempt to resolve this problem. De Rosa discloses a switch arrangement which detects the positions of the trumpet valves and an operator controlled switch which together define the particular note being produced by the instrument. An important drawback to the De Rosa instrument is that it does not allow the musician to control the synthesizer by playing the trumpet in a normal manner. Instead, the musician must not only manipulate the keys while blowing into the instrument, but must also manipulate a note selection switch which is foreign to the trumpet. This additional switch not only increases the difficulty of operating the instrument, but also requires very rapid manipulation of the selection switch when the musician transitions from one note range to another.

It is accordingly one object of the present invention to provide an interface apparatus which allows a musician of an instrument such as a trumpet, tuba, French horn, trombone or the like, to control the operation of a synthesizer by playing the instrument in a normal manner.

It is another object of the present invention to provide a novel music apparatus comprising the combination of a wind instrument operated by the selection of means determining the air column length and the applied wind pressure, an electronic music synthesizer and an interface circuit, whereby the musician controls the operation of the synthesizer by playing the wind instrument in a normal manner.

It is yet another object of the present invention to provide an improved interface apparatus which not only senses the valve positions of the instrument but also the pitch and loudness of the note being played by the musician.

It is a further object of the invention to provide an interface apparatus utilizing improved means of sensing the valve positions.

It is yet another object of the present invention to provide a novel trumpet-to-synthesizer interface apparatus which comprises musician control means allowing the musician to produce vibrato effects or pitch variations in the synthesized sounds.

These and other objects and advantages are achieved by the present invention as will be apparent from the following description of the invention.

SUMMARY OF THE INVENTION

The present invention is a novel musical instrument comprising a wind instrument of the type wherein the note generated is dependent upon the instrument air column length and the musician's lip pressure, a music synthesizer and an interface apparatus. The interface apparatus comprises position sensing means for generating a sensing signal indicative of the instrument air column length, and transducer means for generating a transducer signal indicative of characteristics of the wind pressure being applied by the musician. The interface apparatus further comprises control means arranged to receive the sensing signal and transducer signal. The controller is adapted to process the sensing and transducer signals, and from this information, as well as characteristic information defined by the particular type of wind instrument being employed, generate a synthesizer control signal to control characteristics of sounds to be synthesized by the electronic synthesizer.

Means are also provided to easily allow the musician to produce vibrato effects or vary the pitch of the synthesized sounds. The invention is readily adapted to control various types of synthesizers, such as those having a voltage controlled oscillator for controlling the frequency of synthesized sounds, or to synthesizers controlled by a keyboard matrix.

Other features and improvements are disclosed.

DESCRIPTION OF THE PREFERRED EMBODIMENT

The present invention comrprises a novel music apparatus. The following description of the invention is provided to enable any person skilled in the art to make and use the invention and sets forth the best modes contemplated by the inventors of carrying out their invention. Various modifications, however, to the disclosed embodiments will be readily apparent to those skilled in the art, and the generic principles defined herein may be applied to those modifications. Thus, the present invention is not intended to be limited to the embodiments shown, but is to be accorded the widest scope consistent with the principles and novel features disclosed herein.

The music apparatus of the present invention includes a novel apparatus by which a musician may control the output of a music synthesizer while playing his own wind instrument in a normal manner. The invention is a substantial improvement over the invention disclosed in U.S. Pat. No. 4,342,244, which was adapted to music instruments having a substantially one-to-one relationship between the emitted acoustic tone and the positions of the tone control elements, as in the saxaphone and flute families, the bass clarinets, bassoons, and pianos.

Certain brass instruments such as the trumpet, valve trombone, euphonium, tuba and the slide trombone depart from this one-to-one relationship in that the musician achieves a chromatic scale of more than three octaves through the manipulation of three valves (sometimes four) by varying the lip pressure on the mouthpiece to produce different tones on the natural overtone note series associated with any air column length, i.e., any given valve combination. In the case of the slide trombone, the musician uses a combination of seven basic slide positions and varying lip pressure.

The music apparatus of the present invention includes a novel trumpet-to-synthesizer interface which provides a signal indicative of the particular emitted tone through a novel combination which includes the following elements: (1) minature samarium-cobalt magnets, coupled with Hall effect IC sensors to detect the valve (or slide) position; (2) CMOS 1-OF-8 integrated circuit multiplexer chips to sort out the valve combinations, and provide a corresponding digital output; and (3) phase-locked loop IC decoders to detect the position of a tone on the natural overtone series of any given valve (or slide) combination. In the prior art described above, U.S. Pat. No. 3,938,419, an attempt to address the first two elements was made through the use of electromechanical switches and a matrix of relays. However, with regard to the third element, the only way the player could convey to the synthesizer which tone on the natural overtone series he was playing for a given valve combination on a trumpet, for example, was by concurrently manipulating a cumbersome rotary switch.

Figure 1:
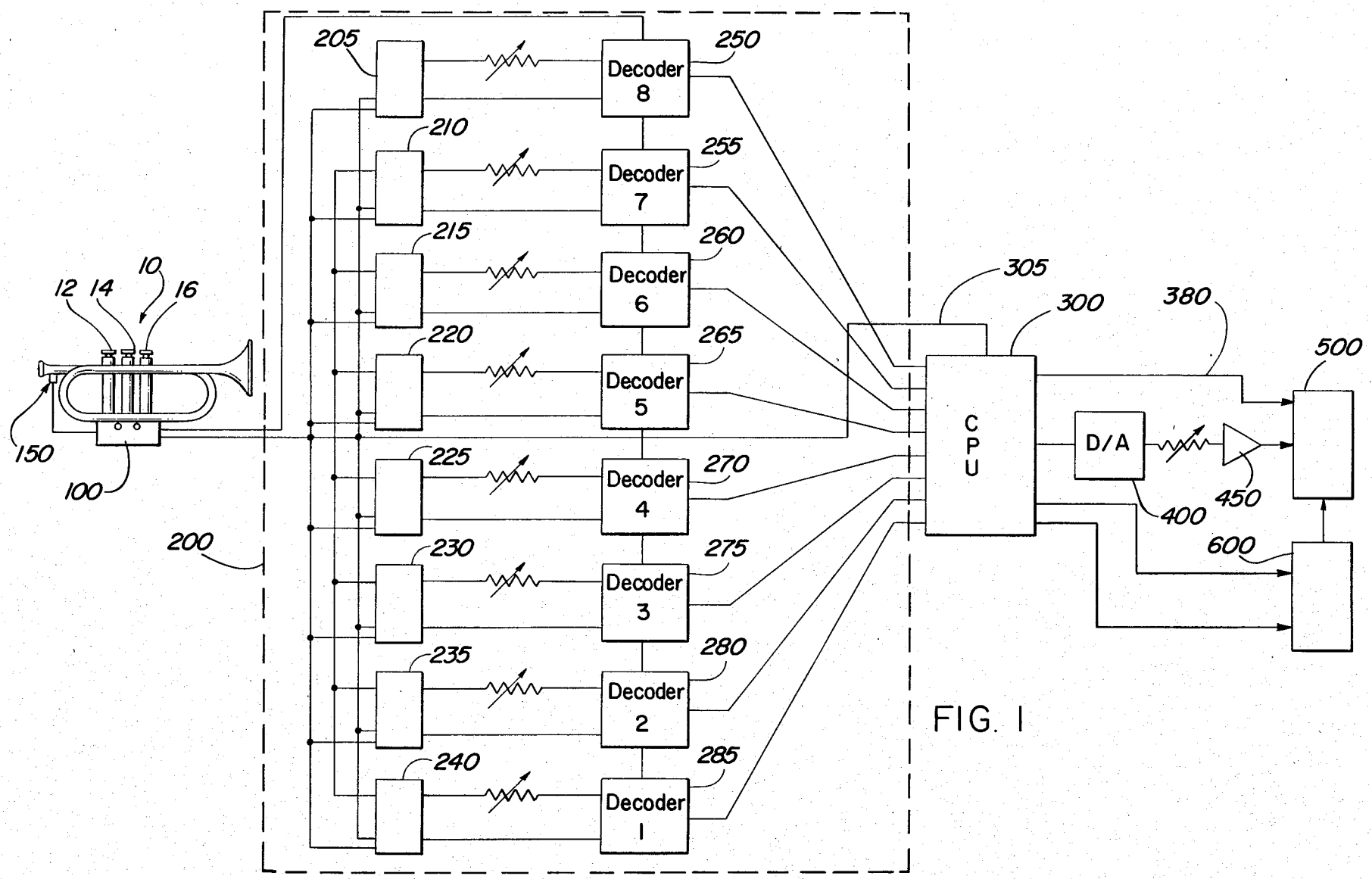
FIG. 1 is a block diagram of the preferred embodiment of the present invention.

Referring now to FIG. 1, a block diagram of the preferred embodiment is disclosed. This embodiment utilizes a B flat trumpted 10 having three valves, 12, 14 and 16. Block 100 depicts an enclosure which contains circuit elements inter alia for sensing the position of each trumpet valve. A mouthpiece transducer 150 is coupled to the mouthpiece of the trumpet 10. The electrical analog output from transducer 150 is coupled to enclosure 100.

Phantom line 200 encloses circuitry for encoding the valve position information. Circuit 200 comprises eight CMOS 4051 integrated circuits, which each comprise an eight-channel analog multiplexer/demultiplexer. Circuit 200 further comprises eight LM 567 tone decoder integrated circuit chips which are collectively used to determine the position of a particular tone on the natural overtone series for any given valve combination.

CPU 300 is coupled to circuit 200 and in the preferred embodiment comprises a Zilog Z80 microprocessor. The CPU monitors the valve sensors and tone decoders and correlates information generated by these elements with a look-up table or algorithm to determine which note is played. CPU 300 then generates a digital output word which is provided to digital to analog converter 400 for generating a control voltage, which is amplified by amplifier 450 and delivered to the synthesizer 500.

The invention is adaptable for use with virtually any synthesizer on the market today. Typical synthesizers utilize a voltage controlled oscillator to select the particular frequency to be synthesized. Thus, the control voltage comprising the output of the digital-to-analog converter 400 in turn defines the frequency to be synthesized. The synthesizer used in connection with the preferred embodiment is an Oberheim OBX synthesizer.

Digital to analog converter 400 in the preferred embodiment is a 10 bit unit, using the six most significant bits. Converter 400 operates in 1/12 volt steps, so that a one octave range is equivalent to a converter voltage differential of one volt.

Alternatively, the output of the CPU could be used in conjunction with a keyboard matrix simulator 600 for ready use with an existing keyboard synthesizer. Still another alternative is to adapt the CPU to the industry standard Musical Instrument Digital Interface ("MIDI"), which provides a standard interface for coupling synthesizers to one another or to a controller.

Figure 2:
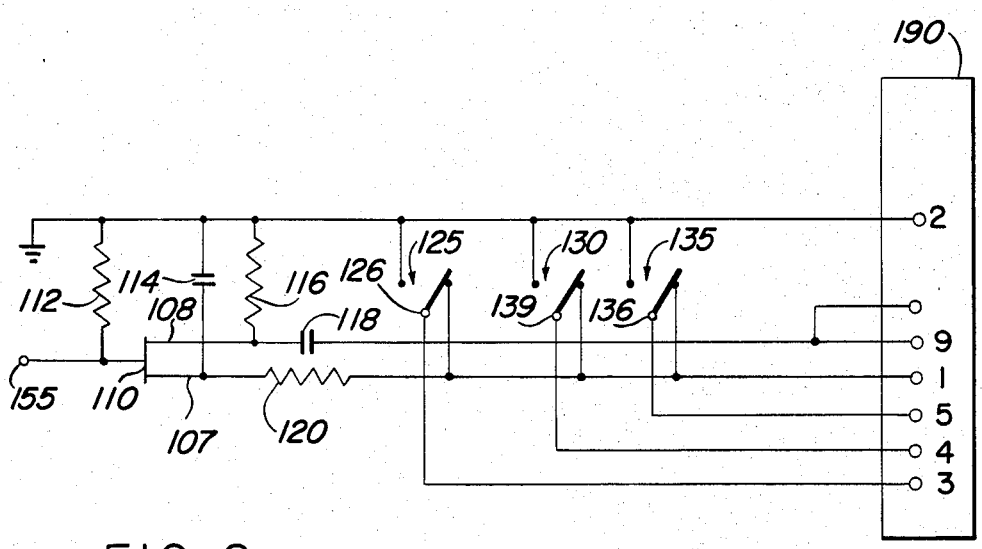
FIG. 2 is a schematic diagram of circuit elements contained on the valve sensing circuit board of the preferred embodiment.

Referring now to FIG. 2, a schematic diagram of the circuitry in enclosure 100, which is physically attached to the trumpet 10, is disclosed. In the preferred embodiment, enclosure 100 is secured to the trumpet by bolts (not shown) which fit through openings between the trumpet valves and are secured by a retainer and wing nuts on the opposite side of the trumpet. This arrangement allows the enclosure to be readily removed by the musician in the event that the trumpet is to be used without the synthesizer and interface circuit. Other arrangements for coupling enclosure 100 and the circuity it carries to the trumpet will be readily apparent to those skilled in the art. The circuitry in enclosure 100 is coupled to the encode/decode circuitry 200 shown in FIG. 1 through a nine pin connector and cable 190.

Terminal 155 is coupled to the signal output of transducer 150 fitted to the trumpet mouthpiece. In the preferred embodiment, a transducer marketed by Barcus- Berry, Inc., Musical Instruments Division, 5782 East Second Street, Long Beach, Calif., 90803, is used. This transducer is a high impedance device, and a high-to-low impedance converter is provided to match the impedance levels. The transducer output signal is an analog signal representative of the audio signal emitted by the trumpet.

Still referring to FIG. 2, device 110 comprises a JFET transistor which couples the transducer output to the remainder of the circuit, acting as a high-to-low impedance converter. Device 110 may comprise, for example, a 2N3321 or 2N3819 JFET transistor. The drain terminal 107 of transistor 110 is coupled through 1 Kohm resistor 102 to pin 1 of connector 190, for connection to the +15 volt supply voltage. Terminal 107 is also coupled through 8 microfarad capacitor 114 to ground. The source terminal 108 of the transistor 110 is coupled through 0.2 microfarad capacitance to terminal 9 of connector 190, and comprises the analog audio output to be coupled to the tone decoders. Source terminal 108 is also coupled to ground by 22 Kohm resistor 116.

Circuitry 105 includes three "Hall effect" digital sensor switches 125, 130 and 135, one for each trumpet valve. Each sensor is cooperatively mounted in enclosure 100 such that the sensor is mounted adjacent the respective valve at the end of travel for the valve piston in its closed configuration. As will be described more fully, minature samarium-cobalt permanent magnets are bonded to the end of each valve piston. Thus, when the valve piston is depressed to the closed position, the magnet is disposed in sufficiently close proximity to the sensor to trigger the switch.

The "Hall effect" sensor switches used in the preferred embodiment are distributed by the Radio Shack division of Tandy Corporation, as catalog part number 276-1646. These switches are magnetically-activated electronic switches utilizing the Hall effect for sensing a magnetic field. Each chip is understood to consist of a silicon Hall generator, amplifier, trigger and output stage integrated with its own voltage regulator onto a monolithic silicon chip. The output transistor is normally "off" when the magnetic field perpendicular to the surface of the chip is below the threshold point. When the field exceeds the threshold, the output transistor switches "on." The output transistor switches "off" when the magnetic field is reduced below the release point which is less than the operate point. This hystersis characteristic provides for unambiguous or non-oscillatory switching in the event of changes in the magnetic field. The nominal operative point of the device is 300 gauss, and a nominal release point is 210 gauss.

The switched outputs 126, 131 an 136 of switches 125, 130 and 135 are respectively coupled to pins 3, 4 and 5 of connector 190. The Hall effect sensors are arranged such that in the normal "off" position, a high output signal, at 15 volts, is provided. In the switched "on" position, a low signal, at ground, is provided. Thus, switches 125, 130 an 135 are nominally open, when the respective valves are open, and the switched outputs 126, 131 and 136 have a nominal high, +15 volt, state. When a valve is closed, the respective output signal switches to the low state, at ground.

In the preferred embodiment, box 100 comprises an alumimum enclosure, although other non-magnetic materials, e.g., a thermoplastic material, could readily be substituted.

Figure 3:
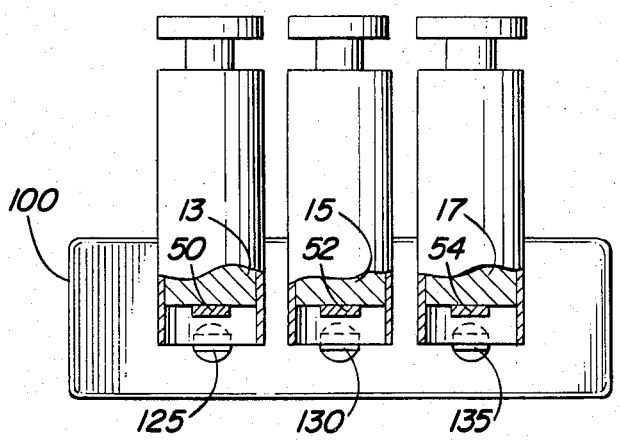
FIG. 3 is a block/schematic drawing illustrating the arrangement of the valve sensing elements utilized in the preferred embodiment.

Referring now to FIG. 3, the spatial relationship between the magnets affixed to the valve piston and the Hall effect sensors is illustrated. Magnets 50, 52 and 54 are respectively affixed to the bottom of the valve pistons 13, 15 and 17. The magnets used in the preferred embodiment comprise miniature samarium cobalt magnets and are affixed to the pistons by glue. Of course, other magnets and means for fixing the magnets in place are suitable for the purpose and will be readily apparent to those skilled in the art.

Sensors 125, 130 and 135 are mounted in enclosure 100 adajacent the lower end of travel of pistons 13, 15 and 17 respectively. Openings are formed in enclosure 100 in the areas between sensor 125 valve 12, sensor 130 and valve 14, and sensor 135 and valve 16. These openings are formed so that the metallic material forming enclosure 100 does not shield the magnetic field of the permanent magnets from the Hall effect sensors.

Figure 5:
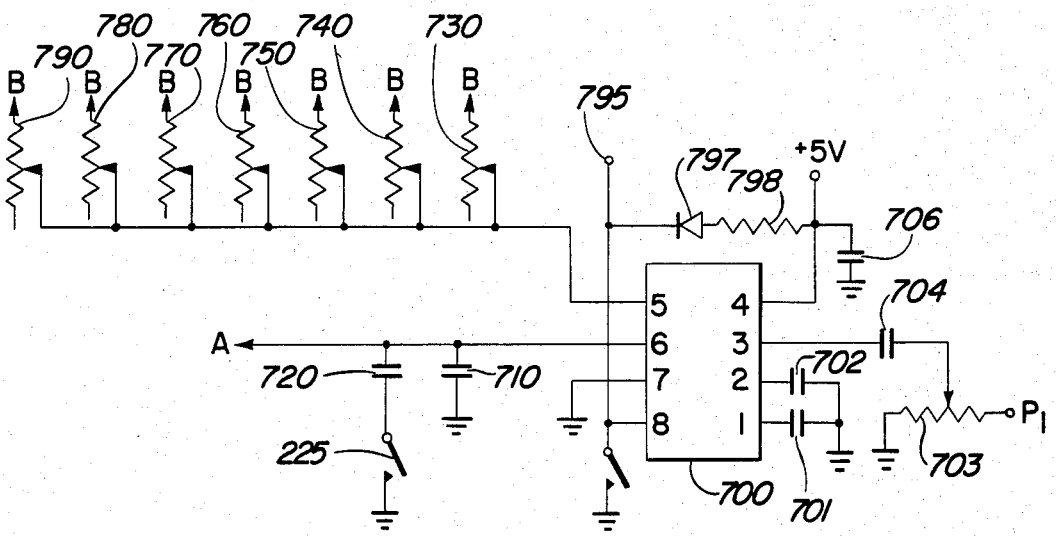
FIG. 5 is a schematic drawing of a typical tone decoder circuit as used in the preferred embodiment.

Referring now to FIG. 5, an exemplary tone decoder circuit is illustrated in schematic form. Chip 700 comprises a LM 567 integrated circuit chip. The LM 567 chip is manufactured, for example, by the Signetics Corporation and comprises a tone and frequency decoder. The operation of this chip is known to those skilled in the art and need not be described in great detail. Briefly, the chip may be operated as a very narrowband detector to detect the presence of a signal in a relatively narrow frequency range. By appropriate selection of the biasing parameters, a resistance and capacitance, the decoder may be tuned to the center of a relatively narrow bandwidth. The bandwidth may be sufficiently narrow to substantially select a single musical note.

The center frequency selection resistance is applied across terminals 5 and 6 of chip 700. The center frequency selection capacitance is coupled from terminal 6 of chip 700 to ground. In the preferred embodiment the selection resistance is selected in multiplexed fashion by operation of the selector chips, e.g., chip 205. Thus, node A is coupled to terminal 3 of the respective multiplexer chip. Each of the nodes B is coupled to the appropriate "$Y_{13}$" terminal 1, 2, 4, 5, 12, 13, 14 or 15.

The multiplexing occurs in the following manner. A plurality of resistors, for example, resistances 730, 740, 750, 760, 770, 780 and 790, are coupled to terminal 5 of chip 700. Each resistance is coupled to a particular one of the addressable terminals of a CD 4051 selector chip. The status of the Hall effect switch outputs 126, 131, 136 determines which one of the addressable terminals is selected, and, therefore, also the particular decoder tuning resistance. Thus, each decoder may be selectively tuned to one of eight possible center frequency selection resistances.

Resistor 730 in FIG. 5 depicts the tuning resistance value for the trumpet open valve configuration, or the first slide position of a trombone. Resistor 740 depicts the tuning resistance value for the valve configuration wherein only the second valve 14 is closed, or alternatively the second slide position.

Resistor 750 represents the timing resistance value for the valve configuration wherein only the first valve 12 is closed, or the third slide position. Resistor 760 represents the timing resistance value for the configuration in which only valves 12 and 14 are closed, or the trombone fourth slide position. Resistor 770 represents the timing resistance value for the configuration in which only valves 14 and 16 are closed, or the fifth slide position. Resistor 780 represents the timing resistance value for the configuration in which only valves 12 and 16 are closed, or the sixth slide position. Resistor 790 represents the timing resistance value for the configuration where all three valves are closed, or the seventh trombone slide position.

Terminal 8 of chip 700 comprises its primary output, the uncommitted output transistor collector. When an in-band input signal is present, the transistor saturates, the collector voltage being less than one volt. Terminal 8 is coupled to output node 795. LED 797 and 470 ohm resistor 798 are coupled in series between node 795 and the +5 volt supply to provide a visual indication that a tone in the selected passband is present. Switch 712 may be closed to manually cause a "tone present" indication; this switch is present only on first tone decoder 205 in the preferred embodiment. Other biasing element values used in the preferred embodiment comprises 2.2 microfarad capacitor 701, 1 microfarad capacitor 702, 0.1 microfarad capacitors 704 and 706, and 100 Kohm potentiometer 703. The audio input from the transducer 150 is coupled through pin 1 of connector 190 to terminal 3 of chip 700 through resistance 703 and capacitor 704.

As will be discussed below, in the preferred embodiment each decoder is not set up to decode tones for all possible configurations of the valves. In the preferred embodiment only thirty-eight notes are decoded.

The center frequency $F_o$ of the passband of the LM 567 chip is selected by the formula $Fo=1.1/RC$, where R is the resistance connected between terminals 5 and 6 of the chip, and C is the capacitance coupling terminal 6 to ground. While either the capacitance or resistance may be varied to tune the center frequency, it is more convenient to use a fixed capacitor 710, and to use trimmer potentiometer for adjusting the center frequency. For the trumpet application, capacitor 710 is 0.33 microfarads; for the trombone, tuba, bass trumpet and like applications, another 0.33 microfarad capacitor 720 may be added by closing switch 725.

While the resistance and capacitance values necessary to tune to the desired frequency may be calculated, it is found that the most expeditious manner to tune to the desired frequency is to use an audio oscillator to generate a tone of the desired frequency, manipulate the trumpet valves to the required configuration, and tune the variable resistance until the synthesizer produces the same tone as that produced by the oscillator. Tuning is performed automatically in the preferred configuration.

Figure 4:
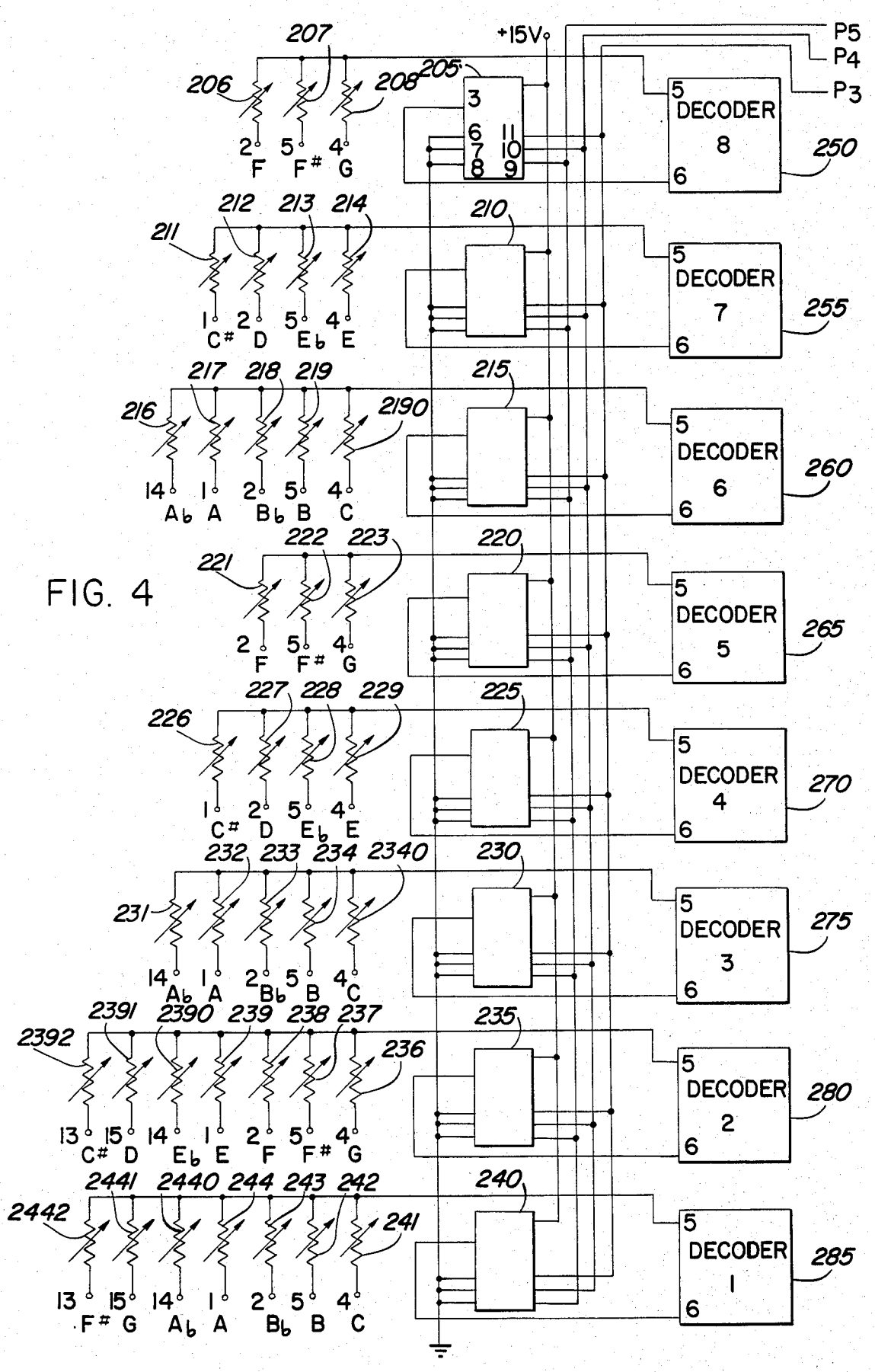
FIG. 4 is a schematic drawing illustrating the tone decoders of the preferred embodiment.

Referring now to FIG. 4, the interconnection between the CD4051 multiplexer chips and the LM567 tone decoder chips of the preferred embodiment is disclosed. This figure further illustrates the specific notes which are decoded for a particular tuning resistive value. Each tone decoder comprises an LM567 chip, a CD4051 multiplexer chip and a plurality of tuning resistances, each selected by a particular trumpet valve combination. As shown in FIG. 5 for a typical tone decoder circuit, terminal 5 of each decoder chip is coupled to a node at which one side of each resistance is connected. The other side of each respective resistor is coupled to one of the eight inputs $Y_o$–$Y_7$ of the multiplexer chip (respectively corresponding to pin terminals 13, 14, 15, 12, 1, 5, 2, 4). The output terminal of the multiplexer chip is coupled to terminal 6 of the LM567 decoder chip. The binary control inputs to the CD4051 multiplexer chip, A0–A2, correspond respectively to pin terminals 11, 10 and 9 of the chip. These control inputs comprise the outputs of the Hall effect switches which indicate the position status of the three trumpet valves. Thus, the three signals 126, 131, 136 which are coupled respectively to pins 3, 4 and 5 of connector 190 may be viewed as as three-bit digital address word where the "high" bit status indicates an open valve, and the low bit status is indicative of a closed valve.

Decoder chip 285 and its associated multiplexer chip 240 include seven possible tuning resistors 241, 242, 243, 244, 240, 2441 and 2442. Each of these resistors comprises a 25 Kohm trimmer potentiometer. Resistor 241 is coupled to terminal 4 of the decoder chip 240 and is tuned to a resistance value for detecting a low C note in the B flat trumpet key. This resistance 241 will be selected only when the valves are all open, i.e., when the multiplexer address word is "111."

Resistor 242 is coupled to terminal 5 of the multiplexer chip 240 and is tuned to detect a "B" note. This resistor will be selected when only valve 14 is closed, i.e., when the multiplexer address word comprises "101." Resistor 243 is coupled to terminal 2 of multiplexer 240 and is selected when only valve 12 is closed, corresponding to a multiplexer address word comprising "011." Resistor 243 is tuned to detect a "B flat" note. Resistor 224 is coupled to terminal 1 of multiplexer 240 and is selected when only valves 12 and 14 are closed. This corresponds to a multiplexer address word comprising "011." This resistance value is tuned to detect an "A" note.

Resistance 2440 is coupled to terminal 14 of multiplexer 240 and is tuned to select an "A flat" note. This corresponds to the valve configuration wherein only valves 14 and 16 are closed, corresponding to the multiplexer address word of "100." Resistor 2241 is coupled to terminal 15 of multiplexer 240 and is tuned to detect the note "G." This resistance is selected when only valves 12 and 16 are closed, corresponding to the multiplexer address word "010." Resistance 2242 is coupled to terminal 13 of multiplexer 240 and is tuned to detect the note "F sharp." This resistance is selected only when all three valves 12, 14 and 16 are closed, corresponding to the multiplexer address word "000."

Decoder chip 280 is coupled to multiplexer 235. This decoder chip and its corresponding multiplexer includes seven possible timing resistances 236, 237, 238, 239, 2390, 2391 and 2392. Each of these resistances comprises a 25 Kohm trimmer potentiometer. Resistance 236 is coupled to terminal 4 of multiplexer 235, and is tuned to detect the note "G." This note is selected only when all three valves are open, corresponding to the address word "111." Resistance 237 is coupled to terminal 5 of multiplexer 235, and is tuned to detect the note "F sharp." This resistance is selected only when 14 is closed, corresponding to the multiplexer address word "101."

Resistance 238 is coupled to terminal 2 of multiplexer 235, and is tuned to detect the note "F." This resistance is selected only when valve 12 is closed, corresponding to the multiplexer address word "011." Resistance 239 is coupled to terminal 1 of multiplexer 235, and is tuned to detect the note "E." This resistance is selected only when valves 12 and 14 are closed, corresponding to the multiplexer address word "001." Resistance 2390 is coupled to terminal 14 of multiplexer 235, and is tuned to detect the note "E flat." This resistance is selected only when valves 14 and 16 are closed, corresponding to the multiplexer address word "100." Resistance 2391 is coupled to terminal 15 of multiplexer 235, and is tuned to detect the note "D." This resistance is selected only when valves 12 and 16 are closed, corresponding to the address word "010." Resistance 2392 is coupled to terminal 13 of multiplexer 235, and is tuned to detect the note "C sharp." This resistance is selected only when all three valves are closed, corresponding to the address word "000."

Decoder chip 275 and its corresponding multiplexer 230 include five possible tuning resistances 231, 232, 233, 234, and 2340. Each of these resistances comprises a 25 Kohm trimmer potentiometer. Resistance 2340 is coupled to terminal 4 of multiplexer 230, and is tuned to detect the note "C." This resistance is selected only when all three valves are open, corresponding to the address word "111." Resistance 234 is coupled to terminal 5 of multiplexer 230, and is tuned to detect the note "B." This resistance is selected only when valve 14 is closed, corresponding to the address word "101." Resistance 233 is coupled to terminal 2 of multiplexer 230, and is tuned to detect the note "B flat." This resistance is selected only when valve 12 is closed, corresponding to the address word "011." Resistance 232 is coupled to terminal 1 of multiplexer 230, and is tuned to detect the note "A." This resistance is selected only when valves 12 and 14 are closed, corresponding to the address word "001." Resistance 231 is coupled to terminal 14 of multiplexer 230, and is tuned to detect the note "A flat." This resistance is selected only when valves 14 and 16 are closed, corresponding to the address word "100."

Decoder chip 270 and multiplexer 225 include four possible tuning resistances 226, 227, 228, and 229. These resistances each comprise 10 Kohm trimmer potentiometers. Resistance 229 is coupled to terminal 4 of multiplexer 225, and is tuned to detect the note "E." This resistance is selected only when all valves are open. corresponding to the address word "000." Resistance 228 is coupled to terminal 5 of multiplexer 225, and is tuned to detect the note "E flat." This resistance is selected only when valve 14 is closed, corresponding to the address word "101." Resistance 227 is coupled to terminal 2 of multiplexer 225, and is tuned to detect the note "D." This resistance is selected only when 12 is closed, corresponding to the address word "011." Resistance 266 is coupled to terminal 1 of multiplexer 225, and is tuned to detect the note "C sharp." This resistance is selected only when valves 12 and 14 are closed, corresponding to the address word "001."

Decoder chip 265 and its corresponding multiplexer 220 include three possible tuning resistances 221, 222 and 223. Each of these resistances comprises a 10 Kohm trimmer potentiometer. Resistance 233 is coupled to terminal 4 of multiplexer 220, and is tuned to detect the note "G." This resistance is selected only when all valves are open, corresponding to the address word "111." Resistance 222 is coupled to terminal 5 of multiplexer 220, and is tuned to detect the note "F sharp." This resistance is selected only when valve 14 is closed, corresponding to the address word "101." Resistance 221 is coupled to terminal 14 of multiplexer 220, and is tuned to detect the note "F." This resistance is selected only when valve 12 is closed, corresponding to the address word "011."

Decoder chip 260 and its corresponding multiplexer 215 include five possible tuning resistances 216, 217, 218, 219 and 2190. Each of these resistances comprises a 10 Kohm trimmer potentiometer. Resistance 2190 is coupled to terminal 4 of multiplexer 215, and is tuned to detect the note "C." This resistance is selected only when all valves are open, corresponding to the address word "111." Resistance 219 is coupled to terminal 5 of multiplexer 215, and is tuned to detect the note "B." This resistance is selected only when valve 14 is closed, corresponding to the address word "101." Resistance 218 is coupled to terminal 2 of multiplexer 215, and is tuned to detect the note "B flat." This resistance is selected only when valve 12 is closed, corresponding to the address word "011." Resistance 217 is coupled to terminal 1 of multiplexer 215, and is tuned to detect the note "A." This resistance is selected only when valves 12 and 14 are closed, corresponding to the address word "001." Resistance 216 is coupled to terminal 14 of multiplexer 215, and is tuned to detect the note "A." This resistance is selected only when valves 12 and 14 are closed, corresponding to the address word "001."

Decoder 255 and its corresponding multiplexer 210 include four possible tuning resistances 211, 212, 213 and 214. Resistance 214 is coupled to terminal 4 of multiplexer 210, and is tuned to detect the note "E." This resistance is selected only when all valves are open, corresponding to the address word "111." Resistance 213 is coupled to terminal 5 of multiplexer 210, and is tuned to detect the note "E flat." This resistance is selected only when valve 14 is closed, corresponding to the address word "101." Resistance 213 is coupled to terminal 2 of multiplexer 210, and is tuned to detect the note "D." This resistance is selected only when valve 12 is closed, corresponding to the address word "011." Resistance 211 is coupled to terminal 1 of multiplexer 210, and is tuned to detect the note "C sharp." This resistance is selected only when valves 12 and 14 are closed, corresponding to the address word "001."

Decoder 250 and its corresponding multiplexer 205 include three possible tuning resistances 206, 207 and 208. Resistance 208 is coupled to terminal 4 of multiplexer 205, and is tuned to detect the note "high G." This resistance is selected only when all valves are open, corresponding to the address word "000." Resistance 207 is coupled to terminal 5 of multiplexer 205, and is tuned to detect the note "F sharp." This resistance is selected only when valve 14 is closed, corresponding to the address word "101." Resistance 206 is coupled to terminal 2 of multiplexer 205, and is tuned to detect the note "F." This resistance is selected only when valve 12 is closed, corresponding to the address word "011."

The foregoing arrangement may be extended to four valve instruments by utilizing multiplexing means adapted to multiplex sixteen possible valve combinations. One way of accomplishing this is to utilize two 4051 multiplex chips in tandem. Alternate methods will be readily apparent to those skilled in the art.

Figure 6:
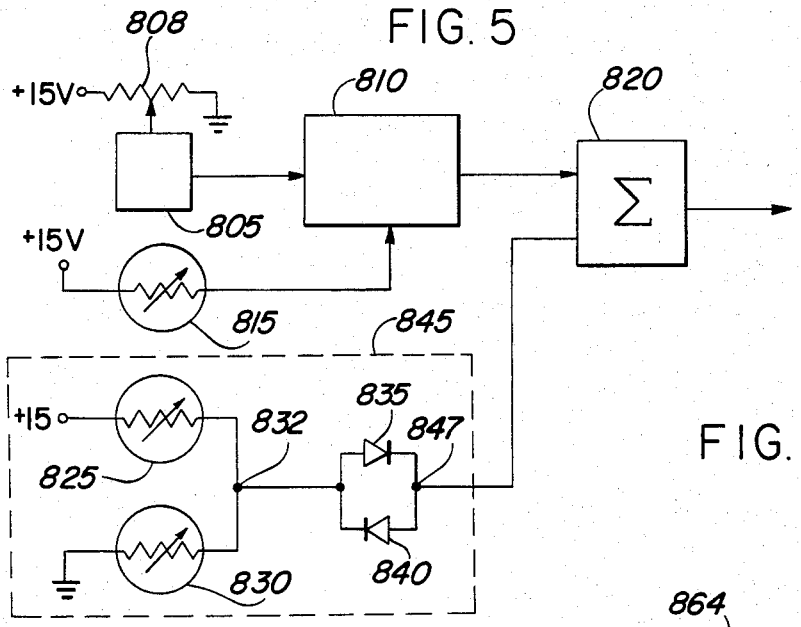
FIG. 6 is a schematic drawing illustrating the manual vibrato and pitch alteration circuit of the preferred embodiment.

Referring now to FIG. 6, a schematic of the vibrato and "pitch bending" circuitry is disclosed. One facet of the present invention is the provision of means allowing the musician to conveniently introduce a vibrato effect on the synthesized note about its nominal frequency. Novel pressure transducers 815, 825 and 830 are attached to the trumpet for convenient reach by the musician's fingers. These transducers each comprise a pair of bowed copper plates each having a concave surface. The plates are fitted adjacent each other with the slightly concave surfaces facing each other with a thin layer of plastic separating the edges of the plates. Pressure sensitive resistive paint is applied to the facing surfaces of the two plates. The transducer is a substantially open circuit until pressure is applied. By pressing the two plates together, the resistance between the plates is varied between 20 Kohms and 500 Kohms. These transducers are represented in FIG. 6 by encircled variable resistances 815, 825 and 830. Leads are attached to each copper plate for providing electrical connection to the transducer.

The variable resistance, pressure sensitive paint used for the preferred embodiment is marketed by Elab Microducers, Costa Mesa, Calif., as part number EM-95. The paint has a force range from zero to one pound.

The pressure transducers are affixed to the trumpet adjacent locations where the musician's fingers are normally disposed while holding the instrument. The trumpet is normally held by the thumb and first finger of the left hand. Thus, the vibrato transducer 815 may be affixed to the first valve so that the thumb of the right hand fits adjacent the transducer. The two transducers 825 and 830, which alter the pitch, may be affixed on the third valve for ready manipulation by the middle finger of the musician's left hand.

The vibrato section comprises vibrato transducer 815, low frequency oscillator 805, speed adjustment potentiometer 808, and variable gain amplifier 810. Transducer 815 couples the +15 volt supply to the control voltage input of low frequency oscillator 805. Oscillator 805 produces a triangle waveform. The frequency of oscillation of oscillator 805 is determined by variable resistance 808. The output of oscillator 805 is coupled to the input of variable gain amplifier 810. The gain of amplifier 810 is controlled by vibrato transducer 815. Thus, a triangle waveform is provided whose amplitude is manually controlled by the amount of pressure exerted by the musician's finger or thumb on transducer 815.

A "pitch bend" control signal is provided by circuit 845. This circuit comprises "up-bend" transducers 825, "down-bend" transducer 830, and diodes 835 and 840. Transducer 825 couples node 832 to the +15 volt supply. Transducer 825 couples node 832 to ground. The two transducers thus combine to form a voltage divider network for adjusting the voltage level at node 832. Diodes 835 and 840 are arranged in a parallel, opposing polarity relationship to couple node 832 to summing circuit 820. The diode arrangement provides a "dead zone," comprising the diode junction voltage drop, required to bias one diode in a conducting state. Thus, a voltage potential across the diodes of at least the junction forward bias voltage is required to bias either diode to the conducting state. Voltage potentials below the forward bias voltage will cause no effect.

Summer 820 sums the output signal of variable gain amplifier 810 and the signal at node 847. The summed signal on line 822 is in turn summed with the control signal which comprises the output of digital-to-analog converter 400, or alternatively may be provided as a signal provided for internal modulation in a polyphonic synthesizer.

Figure 7:
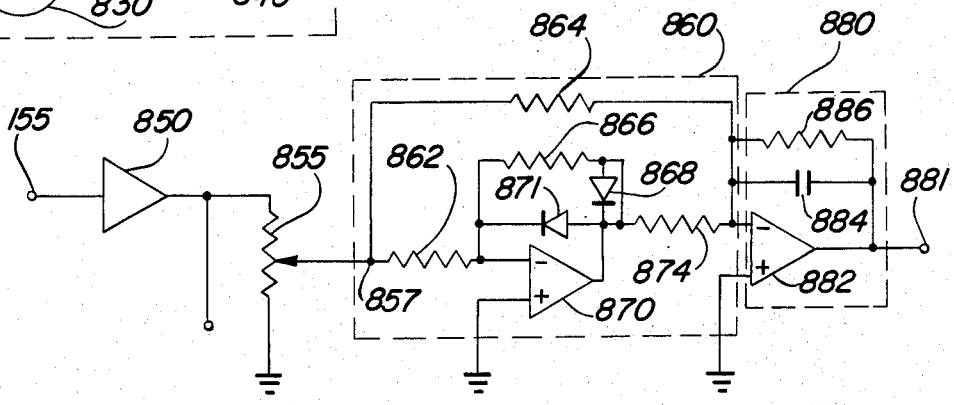
FIG. 7 is a schematic drawing of the loudness detection circuit of the preferred embodiment.

The loudness or volume of the tone generated by the synthesizer 500 may also be controlled by the musician's play of the trumpet in the normal manner. The synthesizers in common use today typically include a voltage controlled amplifier for controlling the amplitude of the generated tones. This control voltage may be supplied from an external source. The circuitry shown in FIG. 7 develops a control signal for controlling a voltage controlled amplifier. As shown in FIG. 2, node 155 is coupled to the output of mouthpiece transducer 155. This output is amplified by amplifier 850 and coupled to potentiometer 855, which acts as a voltage divider. The output 857 from the voltage divider is coupled to full-wave rectifier circuit 860.

Circuit 860 comprises differential amplifier 870, diodes 868 and 871, and resistances 862, 864, 866 and 874. Resistances 862, 864 and 866 each have the same nominal resistance value which is selected to be twice the nominal value of resistance 874. The non-inverting input of differential amplifier 870 is coupled to ground and the input signal at node 875 is coupled to the inverting input of amplifier 870 through resistance 862. The operation of circuit 860 as a full-wave rectifier will be well known to those skilled in the art and need not be described in further detail.

The output of rectifier circuit 860 is coupled to integration circuit 880. This circuit comprises differential amplifier 882, feedback capacitor 884 and feedback resistor 886. The non-inverting input to amplifier 882 is coupled to ground with the rectifier output signal coupled to the inverting input of amplifier 882. The output at node 881 provides the loudness control voltage, which may be coupled to the inverting input of amplifier 882. The output at node 881 provides the loudness control voltage, which may be coupled to the voltage controlled amplifier of the synthesizer, to control the gain of the synthesizer amplifier. The integration circuit provides an averaging effect on the full-wave rectified signal to produce a stable DC control voltage.

The CPU 300 in the preferred embodiment comprises microprocessor of the Zilog Z80 type. As shown in FIG. 1, the input signals to the CPU comprise the output signals from each tone decoder, and the three sensor switch outputs. The three sensor outputs are shown in FIG. 1 collectively as bus 305. Additional inputs (not shown) from footswitches may also be present, providing the musician the means for further control over the synthesizer. The CPU is adapted to scan the eight tone decoders to determine if one or more decoder has gone active. When one or more decoder goes active, the CPU selects the lowest numbered decoder, which corresponds to the lowest frequency, i.e., the fundamental frequency. The CPU correlates the selected decoder information with the valve status information conveyed by the sensor switches through data bus 305 to perform a table "look-up" to determine which note was actually played. Additional information such as octave up/down switches which are operated by foot pedals may also be considered.

With a three valve instrument, such as the B flat trumpet, there are eight possible valve closure combinations, but the situation where only the third valve 16 is closed is not generally different than the situation wherein only first and second valves 12 and 14 are closed. Thus, in the three valve arrangement utilizing eight tone decoders, each decoder may be adapted to detect seven possible notes. This would result in 56 different notes, but in fact there are several impossible combinations. In the preferred embodiment for the B flat trumpet, thirty-eight possible notes are detectable ranging from the written low F sharp note below the staff to the written high G four leger lines above the staff. Other notes could, of course, be programmed.

With most synthesizers on the market today, an input is provided which triggers the attack/decay envelope of each note generated by the synthesizer. The preferred embodiment includes means for providing a trigger signal indicating attack of a new note. This function is carried out by the CPU 300, which monitors the tone decoders for an output "active" state. Once an active state is sensed, the CPU determines which note is to be generated by the synthesizer, outputs the note value to the DAC400, and sets the gate signal triggering the attack decay envelope of this note.

Figure 8:
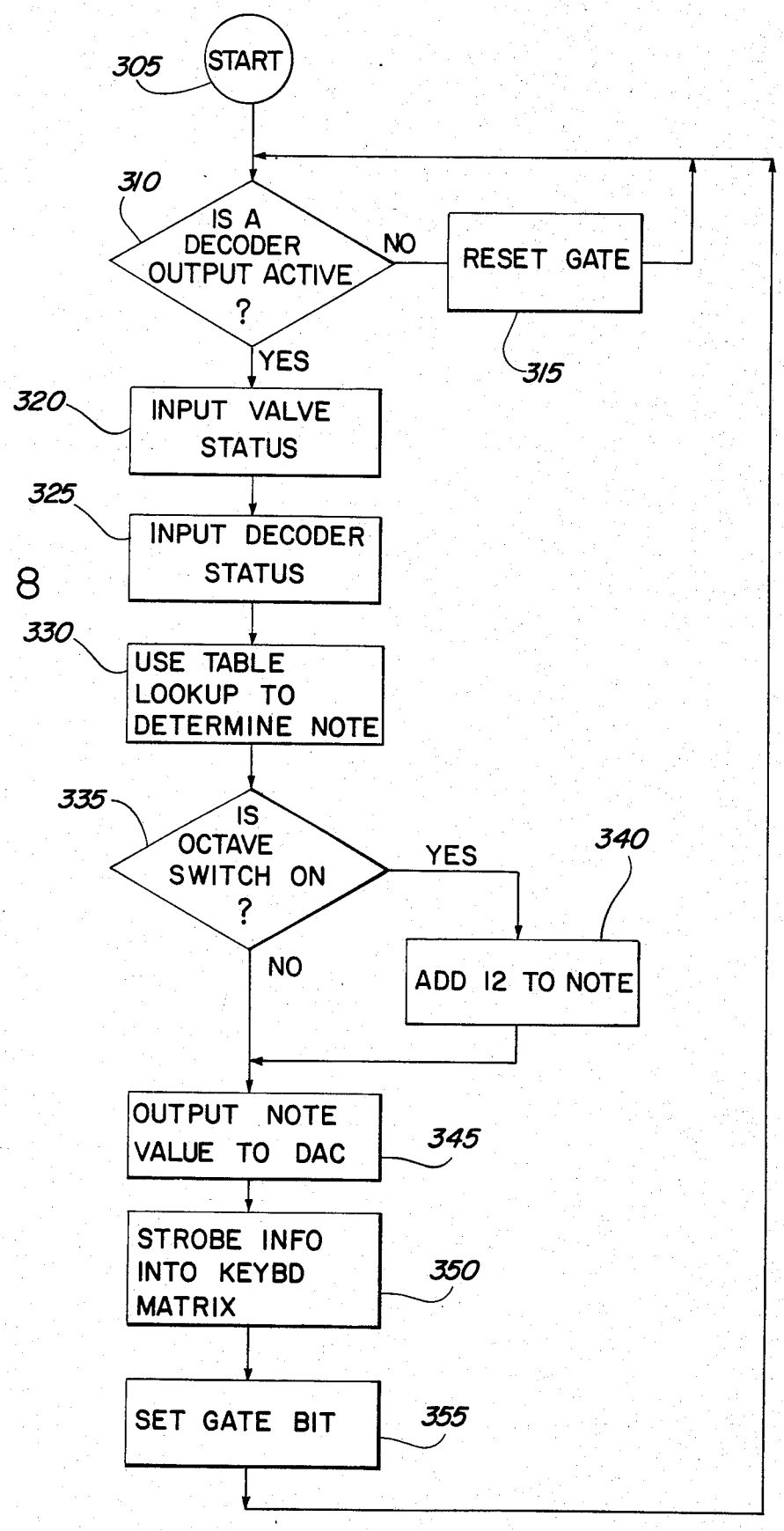
FIG. 8 is a program flow chart illustrating one aspect of the operation of the controller of the preferred embodiment.

The CPU may be programmed in many different ways to carry out its functions. Its basic program steps are outlined in the flow chart of FIG. 8. At step 305 the CPU program is initiated. At step 310 a decision is performed to determine if any decoder output is active. If "no," the gate signal is reset at step 315 indicating that no note is to be synthesized and triggering the decay envelope of any currently being synthesized. The program then loops back to step 310. If a decoder output is active, then at step 320 the valve status information, i.e., the three bit word defined by the status of lines 126, 131 and 136, is received as input information by the program. At step 325 the program receives as input information the tone decoder status. If more than one tone decoder output is active, the program is adapted to ignore all but the decoder indicating the lowest note.

At step 330 the program performs a table "lookup" to determine the information defining the note to be synthesized. This table lookup function is well known to those skilled in the art, and need not be described in detail. Briefly, the valve status and tone decoder information define a digital address word used to address the defined location in a memory. The data stored in memory includes information defining the note to be generated by the synthesizer which correlates to the defined address word.

At step 335 a program decision is made to determine whether an octave switch is "on." This octave may comprise, for example, a foot pedal switch operated by the musician. This switch would enable the musician to raise the synthesized note by one octave over that played by the trumpet. If the octave switch is depressed, 12 is added to the note information at step 340, thereby raising the note by one octave.

At step 345 the note valve is output to DAC 400. At step 350 the note information is strobed into a keyboard matrix (when the instrument is used with a keyboard matrix to simulate signals generated by the keyboard of a keyboard synthesizer.) At step 355 the gate bit is set to trigger the attack/decay envelope of the synthesizer.

The gate bit comprises the status of output line 380 (in FIG. 1). Since the gate device is typically incorporated into the synthesizer, a separate gate device is not shown. Such devices are in any event well known to those skilled in the art.

Table 1 sets forth a "lookup" table correlating the decoder status and value closure status to the note identification. The table values comprise the transposed pitches including frequency (Hertz) for the B flat trumpet. The transposed pitches for the B flat trumpet are one whole step above the corresponding concert pitch. Unoccupied positions in the table matrix indicate valve/overtone combinations which are not used for the B flat trumpet. For other instruments, the tone information would obviously be changed. For example, for the trombone or the bass trumpet the frequencies in Table 1 would be exactly halved. A note could be assigned to each position in the table matrix. An embodiment adpated to the trombone will require additional notes to those set forth in Table 1 for the B flat trumpet.

TABLE 1

| DE- | VALVE CLOSURE COMBINATIONS | | | | | | |
|---|---|---|---|---|---|---|---|
| CODER | 0 | 2 | 1 | 1,2 | 2,3 | 1,3 | 1,2,3 |
| 1 | C | B | B flat | A | A flat | G | F# |
| | 233.1 | 220 | 207.6 | 196 | 185 | 174.6 | 164.8 |
| 2 | G | F# | F | E | E flat | D | C# |
| | 349.2 | 329.6 | 311.1 | 293.2 | 277.2 | 261.8 | 246.9 |
| 3 | C | B | B flat | A | A flat | | |
| | 466.2 | 440 | 415.3 | 391 | 370 | | |
| 4 | E | E flat | D | C# | | | |
| | 587.2 | 554.4 | 523.3 | 493.9 | | | |
| 5 | G | F# | F | | | | |
| | 698.5 | 659.3 | 622.3 | | | | |
| 6 | C | B | B flat | A | A flat | | |
| | 932.3 | 880 | 830.6 | 784 | 640 | | |
| 7 | E | E flat | D | C# | | | |
| | 1174.7 | 1108.7 | 1046.5 | 987.8 | | | |
| 8 | G | F# | F | | | | |
| | 1396.9 | 1318.3 | 1244.5 | | | | |

Typically the note information comprises a six-bit digital word. The CPU may output the note information as a digital word converted to the control voltage for driving the synthesizer voltage controlled oscillator. Alternatively, as shown in FIG. 1, the digital information defining the note may be output to a keyboard simulator 600, which in turn drives the synthesizer by emulating a musician playing a keyboard.

Figure 9:
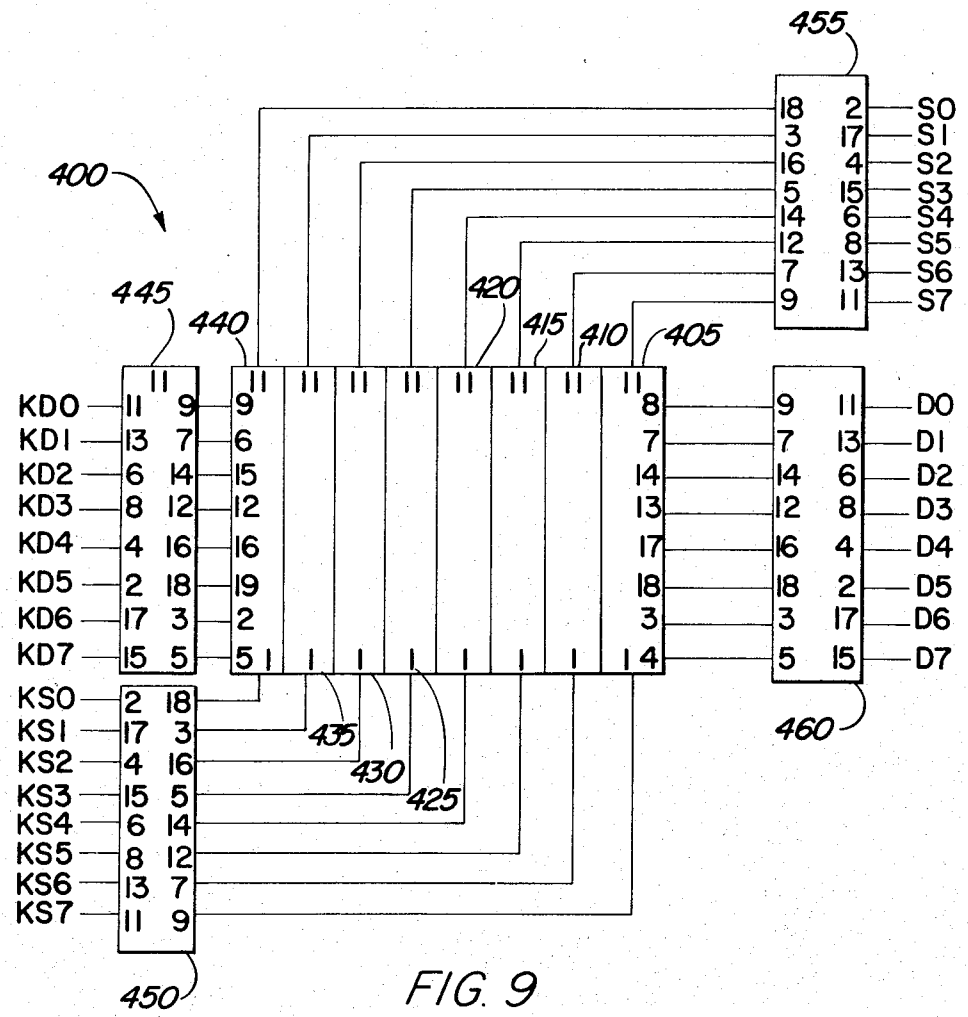
FIG. 9 is a block diagram illustrating the keyboard simulator circuit for an alternate embodiment of the present invention.

Referring now to FIG. 9, a schematic diagram of keyboard simulator circuit 400 is shown. Eight eight-bit latches 405, 410, 415, 420, 425, 430, 435 and 440 are cooperatively coupled together to form a 64 bit, two-port memory (these latches are hereinafter sometimes referred to as the "memory latches"). Each latch comprises a 74 LS 374 tri-state latch. IC chips 445, 450, 455, and 460 comprise either LS 240 or LS 244 buffers, the choice depending upon whether the synthesizer utilizes "high" or "low" active enable lines.

The note information stored by CPU 300 comprises a six-bit digital word. The lowest three bits are used to define which of inputs D0–D7 of buffer 460 is active at a particular instant. The upper three bits are used to define which of the inputs S0–S7 is active at a particular instant. (The numerals inside the blocks indicating chips 445, 450, 455 and 460 are the corresponding pin numbers.) This definition is resolved through the use of two decoder chips (not shown) by which the two three-bit words are respectively decoded to select one of eight outputs. This circuit technique is well known to those skilled in the art and need not be described in further detail. The two lines coupling CPU 300 to keyboard simulator 600 in FIG. 1 comprise eight-bit busses, one each coupling the respective decoder chip to buffers 455 and 460.

The outputs of buffer 460 are coupled in parallel to the data input port of the memory latches. The clock terminal 11 of each memory latch is driven by a respective output from buffer 455, as indicated in FIG. 9. Thus, data is first loaded to buffer 460 and then data is provided to buffer 455. Since only one bit in eight of the data provided either to buffer 455 or 460 will be active, only one memory latch will be clocked with each fresh set of note data. The CPU 300 is programmed to accomplish this sequential loading of data. The programming may be carried out in many different ways, as is well knonw to those skilled in the art. Driven in this manner, the eight memory latches comprise a 64 bit memory to emulate the status of 64 keyboard switches.

The synthesizer is coupled to and reads the memory via buffers 445 and 450. The synthesizer is adapted to sequentially activate one of the "KS_" inputs to buffer 450. The eight outputs of buffer 450 are coupled one each respectively to the output control terminals of each memory latch, as shown in FIG. 9. The data output terminals of each memory latch are each coupled in parallel to the input terminals of buffer 445, as indicated in FIG. 9. The output terminals KD0–KD7 of buffer 445 are coupled to the synthesizer via a data bus. Thus, by sequentially strobing the memory latches, the synthesizer monitors the status of each memory location, corresponding to the status of keyboard switches. This monitoring is accomplished independantly of the loading of data by CPU 300 into the memory latches.

Other techniques for emulating a keyboard in connection with the present invention will be readily apparent to those skilled in the art.

The present invention has been described as including separate interface apparatus and synthesizer apparatus. It will be obvious to those skilled in the art that the interface and synthesizer apparatus may be designed as an integral unit. A novel music apparatus has been described which allows the musician playing a valved or slide wind instrument to control the operation of an electronic music synthesizer simply by playing the wind instrument in the normal manner. The musician may configure the synthesizer to generate substantially the same tone as emitted by the wind instrument, (or any other desired pitch) or can offset the frequency by the octave switch to generate related tones or chords. With ranges up to 7 octaves.

The present invention is readily adapted to use with a slide trombone. Seven "Hall effect" sensor switches may be arranged linearly along a rail mounted adjacent the trombone slide. A permanent magnet may be coupled to the trombone slide such that the sensors detect the placement of the trombone slide in any of the seven slide positions. The magnets are preferably about three inches in length so that off-center positions will still be detected. As with the trumpet, a transducer is mounted in the trombone mouthpiece. Thus, the controller is configured to process the data generated by the slide sensor switches and the transducer in a similar manner as described above with respect to the trumpet so as to generate a synthesizer control signal.

The trombone uses many more partial semitones than the trumpet, since the player can make use of many slide positions whose corresponding valve positions for the trumpet would be out of tune. The slide is more flexible and the musician can move the slide slightly away from a principle position to reach a whole new set of overtones. Thus, it is expected that for the trombone application the apparatus will be adapted to decode more notes than for the trumpet. In fact, the CPU could be programmed in an individual manner to accomodate the characteristics and preferences of the individual musician.

Modifications to the embodiments described above will be readily apparent to those skilled in the art. For example, other techniques for sensing the positions of the wind instrument valves are suitable for the purpose, such as electromechanical switches. The CPU 300 may simply comprise a memory, addressed by the particular values of the valve switches and tone decoders. Moreover, as discussed above, the apparatus may include the industry standard Musical Instrument Digital Interface ("MIDI"). This can be accomplished by the addition of a serial converter to the CPU, and the addition of CPU software needed to provide the necessary protocol of the MIDI.

As has been discussed above, there will be many instances when more than one decoder output will be active. The trumpet is an instrument characterized by its richness in overtones. The low note priority implemented by the CPU ignores the higher notes, and thereby resolves the problem associated with seeking to synthesize notes generated by this instrument.

It should also be noted that the individual decoders are relatively easy to tune because the notes for the trumpet embodiment have been selected to be more than a semitone apart. (In fact, in the preferred embodiment there is at least a three half-tone separation between adjacent decoders). Thus, the tuning tolerances do not have to be particularly close to avoid indicating a false note. The 14% bandwidth of tone decoders utilized in the preferred embodiment is found to work quite well.

The present invention is considered to represent a considerable advance over the conventional pitch-to-voltage converters, which have not been fully successful. The conventional converters analyze an entire spectrum, in contrast to the discrete passbands associated with the individual decoders utilized in the preferred embodiment. The conventional converters have required a substantial settling time to accurately convert a pitch to a voltage, thus resulting in many false note indications when the musician rapidly changes the instrument pitch in relation to the settling time. The above modifications are mentioned by way of example only. Various other modifications to the preferred embodiments may be made and still be included within the spirit and scope of the present invention as defined by the appended claims.

What is claimed is:

1. A music instrument comprising:

wind music instrument means of the type wherein the emitted acoustic notes are dependent upon the placement of selection means determining the instrument air column length;

electronic synthesizer means, including means for generating tones in dependence upon control signals; and interface means coupling said wind instrument means to said synthesizer means, comprising (i) transducer means adapted to provide analog transducer signals corresponding to said emitted acoustic notes, (ii) sensing means for sensing the position of said selection means and generating a sensing signal indicative of said position, and (iii) control means responsive to said transducer signals and said sensing signals for generating a control signal representative of said emitted acoustic notes, said control signal being coupled to said synthesizer means to control sounds to be synthesized by said synthesizer.

2. The instrument of claim 1 wherein said transducer means includes a transducer coupled to the mouthpiece of said wind instrument.

3. The instrument of claim 1 wherein said control means is adapted to provide control signals for causing said synthesizer means to generate tones related to said emitted tones.

4. The instrument of claim 3 wherein said control signal contains information representative of the frequency of the tone to be generated by said synthesizer means.

5. The instrument of claim 1 wherein said control means includes tone decoder means responsive to said transducer signals and said sensing signals, and said decoder means is adapted to sense the presence of transducer signals within preselected frequency ranges.

6. The instrument of claim 5 wherein said tone decoder means comprises a plurality of programmable tone decoder circuits each coupled to said transducer means, and each circuit is adapted to sense the presence of transducer signals within preselected frequency ranges determined in dependence upon said sensing signals and generate decoder circuit signals.

7. The instrument of claim 6 wherein said control means includes memory means for storing digital data indicative of a plurality of tone frequencies, and wherein said control means is adapted to correlate particular sensing signals and decoder circuit signals to digital data stored in said memory means which is indicative of a preselected tone.

8. The instrument of claim 7 wherein said control means further includes digital to analog converter means for converting stored digital data representing tone information to analog control signals representing tone information.

9. The instrument of claim 7 wherein said digital data stored in said memory means is preselected in accordance with the characteristics of the particular type of said wind instrument means.

10. The instrument of claim 1 wherein said wind instrument means comprises a trumpet wherein said selection means comprises three valve means, and said sensing means comprises means for sensing the position of each valve means.

11. The instrument of claim 10 wherein said sensing means comprises means for generating first, second and third sensing signals, each having a first state when said valve means is in the open position and a second state when said valve means is in the closed position.

12. The instrument of claim 11 wherein said sensing means comprises first, second and third magnetic means each adapted to set up a magnetic field, one of said magnetic means being coupled to each valve piston, and first, second and third field sensing means, each adapted to indicate the presence of said magnetic field set up by a corresponding one of said magnetic means when disposed in proximity to said field sensing means.

13. The instrument of claim 12 wherein each of said field sensing means comprises switch means having first and second states, wherein the first state is indicative of the condition wherein the required magnetic field has not been set up proximate to the switch, and a second state wherein the required magnetic field has been set up proximate to said sensing means.

14. A music instrument comprising:

wind music instrument means of the type wherein the emitted notes are dependent upon the frequency of vibration of the musician's lips and the placement of selection means determining the instrument air column length;

electronic synthesizer means adapted to generate acoustic tones in dependence upon control signals; and interface means coupling said wind instrument means to said synthesizer means, comprising (i) transducer means adapted to provide analog transducer signals corresponding to said emitted acoustic notes;

(ii) means for sensing the position of said selection means and generating a sensing signal indicative of said position;

(iii) tone decoder means responsive to said transducer signal for detecting the presence of one or more of a preselected set of tone frequencies, and adapted to generate decoder signals; and (iv) control means for generating a control signal in dependence upon said decoder signals and said sensing signals, said control signal being coupled to said synthesizer means to control characteristics of signals to be synthesized by said synthesizer means.

15. The instrument of claim 14 wherein said transducer signal comprises information indicative of the amplitude of said emitted tones, and said interface means further comprises amplitude control means adapted to process said transducer signals and generate an amplitude control signal for controlling the amplitude of signals to be generated by said synthesizer means.

16. The instrument of claim 14 further comprising vibrato means allowing the musician to selectively introduce a vibrato effect on the sound synthesized by said synthesizer means.

17. The instrument of claim 14 wherein said decoder means is adapted to sense the presence of transducer signals within preselected frequency ranges.

18. The instrument of claim 17 wherein said tone decoder means further includes tuning means responsive to said sensing signals for tuning said decoder means to select said preselected frequency ranges.

19. The instrument of claim 17 wherein said tone decoder means includes a plurality of tone decoders, each adapted to sense the presence of transducer signals within particular frequency ranges determined by said sensing signals.

20. The instrument of claim 14 wherein said control means is further adapted to generate a gate signal coupled to said synthesizer means for controlling the initiation of the attack envelope of sounds to be generated by said synthesizer.

21. The instrument of claim 20 wherein said gate signal is further adapted for controlling the initiation of the decay envelope of sounds to be generated by said synthesizer.

22. Apparatus for interfacing a synthesizer to a wind music instrument of the type wherein the emitted tone is dependent upon wind applied by the musician and the placement of selection means determining the instrument air column length, comprising:

transducer means coupled to said music instrument and adapted to generate an analog transducer signal indicative of the sound produced by such instrument;

sensing means for sensing the position of such position means of said musical instrument and generating binary-valued position signals representing the position of such selection means;

tone decoder means responsive to said transducer signals for detecting the presence of one or more of a preselected set of tone frequencies and arranged to provide binary-valued decoder signals;

central processing unit means (CPU) responsive to said position signals and said decoder signals for generating a digital control signal representative of the frequency of tones to be generated by said synthesizer means; and digital-to-analog converter means for converting said digital control signal to an analog signal adapted to control said synthesizer.

23. A music instrument comprising:

wind music instrument means of the type wherein the emitted tone is dependent upon sounds applied by the musician to a mouthpiece and the placement of selection means determining the instrument air column length;

electronic synthesizer means, including means for generating tones in dependence upon control signals; and interface means coupling said wind instrument means to said synthesizer means, comprising:

(i) transducer means for generating a transducer signal indicative of characteristics of the sound applied by the musician, said transducer means including means coupled to the mouthpiece of said wind instrument adapted to sense the sound applied to the wind instrument;

(ii) sensing means for sensing the position of said selection means and generating a sensing signal;

(iii) tone decoder means coupled to said transducer means and said sensing means, comprising a plurality of tone decoder circuits each coupled to said transducer means and adapted to sense transducer signals within predetermined frequency ranges and generate decoder circuit signals; and (iv) control means for generating a control signal in dependence upon said transducer signal and said sensing signal, said control signal being coupled to said synthesizer means to control characteristics of signals to be synthesized so as to generate tones related to substantially the same tones as determined by the sounds applied by the musician and positioning of said selection means, said control means further comprising random access memory means (RAM) for storing digital data indicative of a plurality of tone frequencies, said sensing signals and said decoder circuit signals determining memory addresses for such RAM, and wherein said control means is adapted to correlate particular sensing signals and decoder circuit signals to digital data stored in said memory means which is indicative of a preselected tone.

24. A music instrument comprising:

wind music instrument means of the type wherein the emitted tone is dependent upon sounds applied by the musician to a mouthpiece and the placement of selection means determining the instrument air column length;

electronic synthesizer means, including means for generating tones in dependence upon control signals; and interface means coupling said wind instrument means to said synthesizer means, comprising:

(i) transducer means for generating a transducer signal indicative of characteristics of the sound applied by the musician, said transducer means including means coupled to the mouthpiece of said wind instrument adapted to sense the sound applied to the wind instrument;

(ii) sensing means for sensing the position of said selection means and generating a sensing signal;

(iii) tone decoder means coupled to said transducer means and said sensing means, comprising a plurality of tone decoder circuits each coupled to said transducer means and adapted to sense transducer signals within predetermined frequency ranges and generate decoder circuit signals; and (iv) control means for generating a control signal in dependence upon said transducer signals and said sensing signal, said control means comprising:

(a) keyboard simulator means adapted to emulate the status of keys in a keyboard operated instrument, said control signals comprising sets of keyboard signals indicating the status of such keys in said simulated keyboard, said control signals being coupled to said synthesizer means to control characteristics of signals to be synthesized so as to generate tones related to substantially the same tones as determined by the exerted sound and positioning of said selection means, and (b) memory means for storing digital data indicative of a plurality of tone frequencies, and wherein said control means is adapted to correlate particular sensing signals and decoder circuit signals to digital data stored in said memory means which is indicative of a preselected tone.

25. A music instrument comprising:

wind instrument means of the type wherein the emitted tone is dependent upon sounds applied by the musician to a mouthpiece and the placement of selection means determining the instrument air column length;

electronic synthesizer means adapted to generate acoustic tones in dependence upon control signals; and interface means coupling said wind instrument means to said synthesizer means, comprising (i) transducer means for generating a transducer signal indicative of the frequency of the tone which would be generated by said wind instrument in dependence upon the sounds applied by the musician and upon placement of said selection means;

(ii) sensing means for sensing the position of said selection means and generating sensing signals having binary states;

(iii) tone decoder means coupled to said transducer means and said sensing means and adapted to generate decoder signals, comprising a plurality of tone decoders, each adapted to sense the presence of transducer signals within preselected frequency ranges determined by said sensing signals, and multiplexing means coupled to each decoder for selecting one of said preselected frequency ranges in dependence upon said sensing signals; and (iv) control means for generating a control signal in dependence upon said decoder signals and said sensing signals, said control signal being coupled to said synthesizer means to control characteristics of signals to be synthesized by aid synthesizer means.

26. The instrument of claim 25 wherein each of said tone decoders is adapted to generate a signal having a first state when said decoder senses the presence of a signal within the preselected frequency range and a second state when said decoder does not sense the presence of a signal within the preselected frequency range.

27. The instrument of claim 26 wherein said control means includes memory means having randomly accessably memory locations in which are stored digital data corresponding to the notes to be synthesized by said synthesizer means, and said sensing signals and said tone decoder signals comprise the address of the memory location of said memory means.

28. The instrument of claim 27 further comprising octave control means adapted to allow the musician to selectively raise or lower the pitch of the sound synthesized by said synthesizer means by octave steps about the nominal pitch defined by said data stored in said memory means.

29. The instrument of claim 27 further comprising pitch means allowing the musician to selectively vary the pitch of the sound synthesized by said synthesizer means about the nominal pitch defined by said data stored in said memory means.

30. The instrument of claim 29 wherein said pitch means further comprises pressure sensitive transducer means coupled to said wind instrument means and arranged to provide a pitch signal in dependence upon the amount of pressure the musician applies to said transducer means.

31. The instrument of claim 30 wherein said pitch means comprises first and second pitch transducer means adapted to allow the musician to vary the pitch upwardly or downwardly from said nominal pitch.

32. A music instrument comprising:

wind music instrument means of the type wherein the emitted tone is dependent upon the sounds applied by the musician to a mouthpiece and the placement of selection means determining the instrument air column length;

electronic synthesizer means adapted to generate acoustic tones in dependence upon control signals; and interface means coupling said wind instrument means to said synthesizer means, comprising (i) transducer means for generating a transducer signal indicative of the frequency of the tone which would be generated by said wind instrument in dependence upon the applied sounds and the placement of said selection means;

(ii) means for sensing the position of said selection means and generating a sensing signal;

(iii) tone decoder means coupled to said transducer mean and sensing means, and adapted to generate decoder signals;

(iv) control means for generating a control signal in dependence upon said decoder signals and said sensing signals, said control signal being coupled to aid synthesizer means to control characteristics of signals to be synthesized by said synthesizer means; and (v) vibrato means allowing the musician to selectively introduce a vibrato effect on the synthesized sound, comprising pressure sensitive transducer means coupled to said wind instrument means and arranged to provide a vibrato signal in dependence upon the amount of pressure applied to said transducer means.

33. The instrument of claim 32 wherein said pressure sensitive transducer means comprises a pair of bowed metallic plates separated by a pressure sensitive resistive material.

34. The instrument of claim 32 wherein said vibrato signal is summed with said control signal to provide a summed control signal to said synthesizer means.

35. Apparatus for interfacing a wind music instrument of type wherein the emitted tone is dependent upon sounds applied by the musician to a mouthpiece and the placement of selection means determining the instrument air column length comprising:

transducer means coupled to said music instrument and adapted to generate an electrical transducer signal indicative of characteristics of the sound produced by such instrument;

sensing means for sensing the position of said selection means of said musical instrument and generating a digital position signal representing the position of said selection means;

decoder means coupled to said transducer means and said sensing means, and arranged to provide digital decoder signals;

central processing unit means (CPU) arranged to receive said position signal and said digital decoder signals and generate a digital control signal representative of the frequency of tones to be generated by a synthesizer means, said CPU including random access memory means (RAM) wherein digital tone information representing nominal frequencies of tones to be generated by a synthesizer is stored; and digital-to-analog converter means for converting said digital control signal to an analog signal adapted to control a synthesizer.

36. The apparatus of claim 35 wherein said digital tone information stored in said RAM is adapted to a particular type of such wind instrument.

37. The apparatus of claim 35 wherein said digital position signals and said decoder signals determine the RAM address at which the digital tone information corresponding to said position and decoder signals is stored.

38. The apparatus of claim 37 wherein said tone decoder means includes a plurality of tone decoders each adapted to indicate the presence of a tone generated by said wind instrument within preselected frequency ranges, and said CPU is adapted to select that tone decoder indicating the presence of a tone in the lowest frequency range to select digital tone data stored in said RAM.

39. Interface apparatus for interfacing an electronic synthesizer to a wind music instrument of the type wherein the emitted note is dependent upon the placement of selection means determing the instrument air column length, comprising:

transducer means adapted to provide an analog transducer signal indicative of the emitted note;

sensing means for sensing the position of said selection means and adapted to provide a sensing signal representative of the position of said selection means;

a plurality of programmable tone decoders responsive to said transducer signal and said sensing signals, said decoders adapted to be programmed by said sensing signals to detect the presence of preselected notes in said transducer signals, and control means responsive to said tone decoder and adapted to generate synthesizer control signals, whereby the operation of said synthesizer is controlled by the playing of the wind instrument in a substantially normal manner.

40. The invention of claim 39 wherein said tone decoders are adapted to detect the presence of signal within a predetermined frequency range centered about said predetermined notes.

41. The invention of claim 40 wherein said tone decoders an adapted so that said sensing signals select circuit elements which determine said predetermined frequency ranges.

42. The invention of claim 41 wherein said tone decoders comprise multiplexing means controlled by said sensing signals, and wherein said multiplexing means couples a preselected circuit element to said tone decoder in dependence upon said sensing signals.

43. Apparatus for generating a control signal representative of notes generated by a wind musical instrument of the type wherein, for each placement of selection means determining the instrument air column length, the emitted rate note may comprise the fundamental tone or one of several overtones, comprising:

transducer means adapted to provide an analog signal corresponding to the emitted sounds;

sensing means for sensing the position of said selection means and providing a sensing signal representative of the position of said selection means;

programmable tone detectors responsive to said analog signal and programmed by said sensing signals to respectively detect the fundamental note and at least one of the overtone notes associated with that position of the selection means, and provide tone decoder signals indicative of such note detection, and control means responsive to said tone decoder signals and adapted to provide a control signal indicative of the note generated by said music instrument.

* * * * *